US009890637B2

(12) United States Patent
Cucino

(10) Patent No.: US 9,890,637 B2
(45) Date of Patent: Feb. 13, 2018

(54) PROCEDURE FOR THE CONSTRUCTION OF CROSS PASSAGES IN DOUBLE PIPE TUNNELS

(71) Applicants: SWS ENGINEERING S.P.A., Trento-Frazione Mattarello (IT); PALMIERI S.P.A., Gaggio Montano (IT)

(72) Inventor: Paolo Cucino, Trento-Frazione Mattarello (IT)

(73) Assignees: SWS Engineering S.p.A., Trento-Frazione Mattarello (IT); Palmiere S.p.A., Gaggio Montano (IT)

( * ) Notice: Subject to any disclaimer, the term of this patent is extended or adjusted under 35 U.S.C. 154(b) by 0 days.

(21) Appl. No.: 15/104,226

(22) PCT Filed: Dec. 15, 2014

(86) PCT No.: PCT/IB2014/066897
§ 371 (c)(1),
(2) Date: Jun. 13, 2016

(87) PCT Pub. No.: WO2015/087311
PCT Pub. Date: Jun. 18, 2015

(65) Prior Publication Data

US 2016/0319664 A1 Nov. 3, 2016

(30) Foreign Application Priority Data

Dec. 13, 2013 (IT) ..... MO2013A0343

(51) Int. Cl.
*E21D 9/00* (2006.01)
*E21D 11/00* (2006.01)
(Continued)

(52) U.S. Cl.
CPC ..... *E21D 9/008* (2016.01); *B61B 13/10* (2013.01); *E21D 9/00* (2013.01); *E21D 9/10* (2013.01)

(58) Field of Classification Search
USPC ..... 405/138, 139
See application file for complete search history.

(56) References Cited

U.S. PATENT DOCUMENTS 4,804,295 A * 2/1989 Kondo ..... E21B 10/12 299/31
5,634,692 A 6/1997 Kaneko et al.
7,004,679 B2 * 2/2006 Naka ..... E21D 3/00 405/135

FOREIGN PATENT DOCUMENTS

DE 3810398 A1 10/1989
JP H01121423 A 5/1989
(Continued)

OTHER PUBLICATIONS

International Search Report dated Sep. 30, 2015 from International Patent Application No. PCT/IB2014/066897 filed Dec. 15, 2014.

*Primary Examiner* — Sean D Andrish
(74) *Attorney, Agent, or Firm* — Sunstone IP

(57) ABSTRACT

The procedure for the construction of underground transport infrastructures, comprises the steps of:

excavating an underground transport tunnel comprising a first pipe and a second pipe substantially parallel to one another;

making a bypass tunnel connecting the first pipe and the second pipe which comprises the sub-steps of:

introducing a launching chamber along the first pipe up to a first predefined position chosen along the longitudinal direction of the first pipe, the launching chamber being able to launch a tunnel boring machine;

(Continued)

introducing an arrival chamber along the second pipe up to a second predefined position chosen along the longitudinal direction of the second pipe, the arrival chamber being able to receive the tunnel boring machine;

excavating the bypass tunnel making the tunnel boring machine move forward from the launching chamber to the arrival chamber along a direction transversal to the first pipe and to the second pipe.

5 Claims, 3 Drawing Sheets

(51) Int. Cl.
*B61B 13/10* (2006.01)
*E21D 9/10* (2006.01)

(56) References Cited

FOREIGN PATENT DOCUMENTS

| | | | | |
|---|---|---|---|---|
| JP | H11148296 | A | | 6/1999 |
| JP | 2000257372 | A | | 9/2000 |
| JP | 2002106289 | A | | 4/2002 |
| JP | 3543188 | | * | 7/2004 |

* cited by examiner

Fig. 1
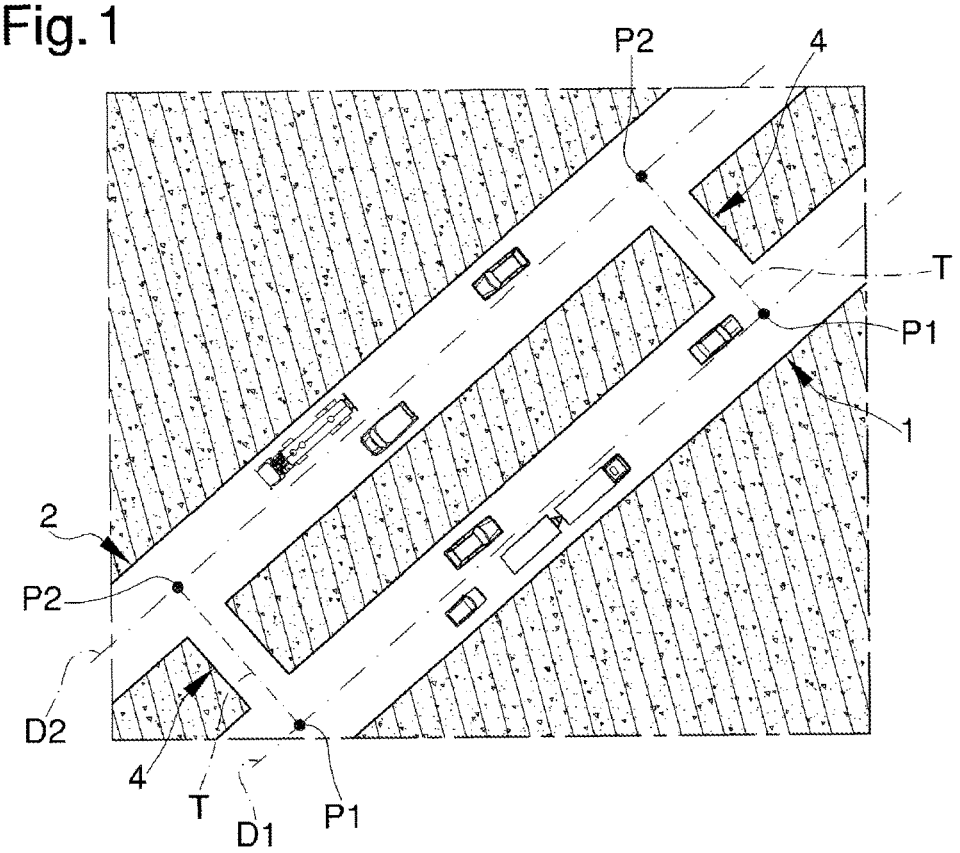
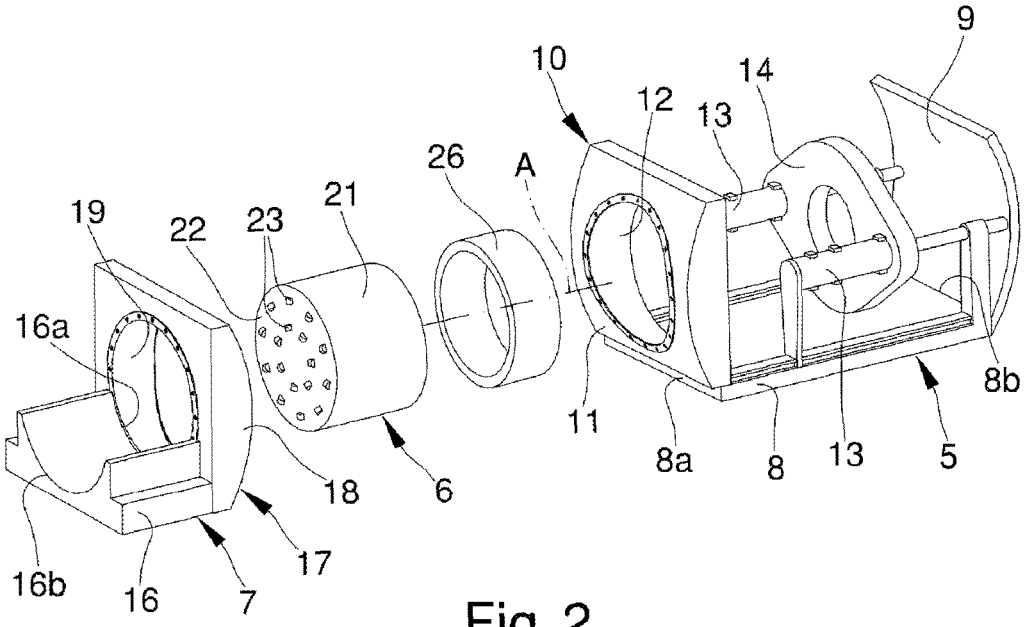
Fig. 2

PROCEDURE FOR THE CONSTRUCTION OF CROSS PASSAGES IN DOUBLE PIPE TUNNELS

TECHNICAL FIELD

The present invention relates to a procedure for the construction of underground transport infrastructures, mainly lines for the urban and metropolitan mass transport performed underground in double pipe configuration, each with a unidirectional single transport way.

BACKGROUND ART

As is known, the greater demand for mobility, the growing urbanization of the territory, pressing technological development, the increasing value of urban land and the investment capacity of institutions have resulted in considerable development as regards the construction of mass transport infrastructures, of the road, motorway, railway and underground railway type.

Such infrastructures mainly occupy underground space which offers areas available for sustainable development of infrastructures.

This development has also been strongly facilitated by the exponential technological development of excavating equipment which makes it possible to do works once prohibitive, in reliable times and at reliable costs, while respecting and totally safeguarding safety, the territory and pre-existences.

This has given rise to and permitted the building, planning and design of major infrastructures in terms of complexity and efficiency, aimed at minimizing risks and maximizing user safety.

Furthermore, the quest for continuous improvements to transport infrastructures, not only in terms of operating capacity and management but also of the safety of users during operation, involves further developments in technological installations and fittings which increase the value of the work.

In this respect, the fact is underlined that underground transport infrastructures stretching for long distances (over 2,000 m) base their safety concept during operation on the double pipe configuration, each of which unidirectional, connected to transversal passages called "bypasses" or "cross passages".

In case of an accident, fire or other catastrophic event involving one of the two pipes, the transversal passages make it possible to place all the environments of the tunnel in communication to use the other pipe as a safe place and/or escape route.

The construction of the bypass tunnel is usually carried out after the two main pipes, which are excavated using special mechanical boring machines to support the balanced front, have been made.

This equipment makes excavating the main pipes of the tunnels efficient and safe with reliable and low building costs.

Building bypass tunnels on the other hand has no comparable excavation alternative using mechanized systems similar to the boring machines for excavating the main tunnels.

The building of the "cross passages", in the majority of installations, requires the completion of excavations using traditional method, i.e., removing the earth with appropriate mechanical means (excavators, rippers, bucket excavators, . . . ) following a preliminary treatment of the soil so as to improve its mechanical characteristics.

The excavation operations are performed following a defined time sequence which envisages:

- excavation of the two main pipes generally done using tunnel boring machines wherein the excavation and lining of the tunnels is done in an automated way. The lining consists of reinforced concrete rings consisting of a certain number of precast segments assembled on site;
- carrying out of pre-consolidation jobs on the outline of the future bypass section for the purpose of improving the mechanical characteristics of the material to be excavated. Such jobs must be performed from one or both main tunnels, often in the presence of very tight spaces to accommodate the equipment needed to perform such jobs, or, if possible, working from the surface;
- installation of a structure to support the segment lining, generally consisting of metal profile sections, which must in part be demolished to create the opening from where to approach the bypass excavation;
- after the demolition of part of the tunnel lining, bypass excavation, which is performed using excavators and other machines for recesses of about one meter followed by the installation of the first-phase lining, generally consisting of shotcrete reinforced with metal profile sections, known as centring;
- after completion of the bypass excavation with the demolition of the arrival tunnel lining, installation of the bypass impermeabilization system, which is applied directly on the first-phase lining and consists of membranes made of sheets of plastic material or sprayed, subsequently lined with an on-site and usually reinforced concrete casting;
- preparation of finishes and plant engineering systems inside the bypass which permit starting its operation.

Such infrastructures are habitually used in the following two ambits:

- building of crossing pass tunnels or underpasses of more or less important morphological elevations more than 2,000 m long, prevalently performed in rock masses with discreet mechanical characteristics in generally not very urbanized contexts with generally rather limited impacts on the context. The sensitivity of the building ambit as regards the construction of the installation is rather low and building complexity is not generally tied to the characteristics of the geological-geotechnical-hydrogeological ambit but rather to the unknown factors intrinsically involved;
- tunnels connected to the underpassing of urban contexts and infrastructures tied to mass transport metropolitan networks, which are generally performed in a strongly urbanized context sensitive and susceptible to interferences with excavation operations. They consist in rather complex installations mainly because of the concurrence of two dominating factors, i.e., the geological-geotechnical-hydrogeological context and the sensitivity of the environment to the excavation. These installations are generally made inside loose soils with poor mechanical characteristics, often located below the level of the water table with reduced cover between the tunnel crown and the ground level, and sometimes also with the presence of (natural) gas.

It is therefore easy to appreciate that the construction of underground transport infrastructures complete with bypass tunnels is a very complex and problematic activity, in particular when performed in urban and metropolitan contexts, and the need is strongly felt to find cutting edge technology and innovative solutions such as to allow building the above installation parts in an efficient, safe and easily repeatable way, so as to maximize the benefits and minimize risks, above all where reference is made to the bypass tunnel building phase.

The excavation and bypass building method most widely used to date in fact certainly does not achieve the level of mechanization and industrialization applicable for the excavation of the main tunnels.

The procedures used, above all in the case of work excavations and consequently cross passages involving loose soils, underneath the water table, in particularly sensitive urban contexts, are rather complex, localizing in the areas of reference particularly difficult soil consolidation and impermeabilization jobs (freezing, injections by means of concrete and/or chemical mixes) in order to allow excavating bypass tunnels in conditions of safety for the workers and the urban context.

The above jobs involve a number of difficulties/critical situations, listed below:

- particularly restricted work environment for carrying out the excavation and consolidation jobs;
- high sensitivity and dependency of the excavation operations and cable stability on the success of the consolidation jobs;
- risks relating to the imperfect success of the cable impermeabilization jobs due to the effect of the injection jobs;
- low level of industrialization of the building processes which potentially reduce the level of safety and quality of the building process.

DESCRIPTION OF THE INVENTION

The main aim of the present invention is to provide a procedure for the construction of underground transport infrastructures which permits introducing strongly developed and technologically advanced excavation methods which have an industrial type approach to therefore ensure quality and safety.

A further object of the present invention is to provide a procedure for the construction of underground transport infrastructures wherein it is possible to control, in a constant and rigorous way, the work erection process in terms of structural stability, minimize the impacts and interferences on the context, maximize safety for workers and everything that interferes with the excavation, and ensure compliance with deadlines and costs.

Another object of the present invention is to provide a procedure for the construction of underground transport infrastructures which allows overcoming the mentioned drawbacks of the state of the art within the ambit of a simple, rational, easy, effective to use and low cost solution.

The above mentioned objects are achieved by the present procedure for the construction of underground transport infrastructures having the characteristics mentioned in the enclosed claim 1.

BRIEF DESCRIPTION OF THE DRAWINGS

Other characteristics and advantages of the present invention will become better evident from the description of a preferred but not exclusive embodiment of a procedure for the construction of underground transport infrastructures, illustrated by way of an indicative, but not limitative, example in the accompanying drawings in which:

FIG. 1 is a plan, schematic and partial view, of an infrastructure made by means of the procedure according to the invention;

FIG. 2 is an exploded view of a detail of the equipment used in the procedure according to the invention;

EMBODIMENTS OF THE INVENTION

Figure 3:
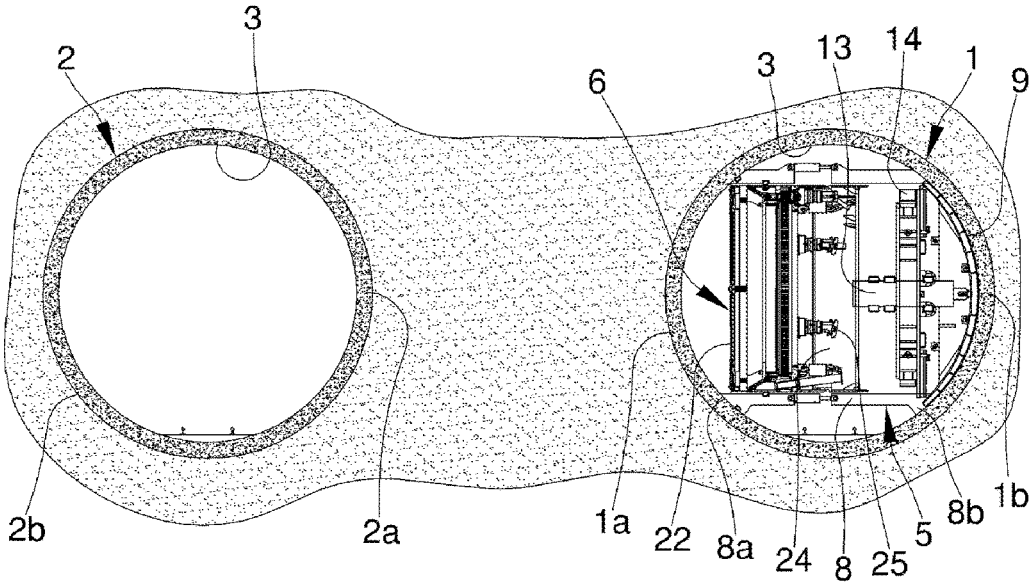
FIGS. 3 to 6 are a sequence of cross-sectional, schematic and partial views, illustrating the various stages of the procedure according to the invention.

By means of the procedure in accordance with the present invention, for example, transport infrastructures can be built such as roads, motorways, railways and underground railways, which are constructed underground in the double pipe configuration, each pipe being dedicated to a unidirectional single transport way.

The procedure, in particular, comprises a first step which consists in excavating at least an underground transport tunnel, i.e., a tunnel able to house one of the above transport infrastructures.

The underground transport tunnel comprises a first pipe 1 and a second pipe 2 substantially parallel to one another.

The excavation of the pipes 1, 2 can be done using traditional methods (by means of the use of dynamite and/or roadheader) but preferably it is done using the mechanized method (using tunnel boring machines of the tunnel boring machine (TBM) or earth pressure balance (EPB) type).

The adoption of the mechanized method permits conforming the pipes 1, 2 with a substantially constant circular section, with a diameter approximately equal to the diameter of the boring machine unless the inner lining 3 of the pipes themselves.

By way of example only, it is specified that the excavation of the pipes 1, 2 can be done with boring machines having a diameter of around 6-9 meters.

In the embodiment shown in the illustrations, for example, the diameter of the boring machine used for the excavation of the pipes 1, 2 is preferably equal to about 6.5 m.

The excavation of the two pipes 1, 2 is done so as to define a longitudinal direction D1, D2 for each pipe 1, 2, i.e., a path that can be rectilinear, curvilinear or mixed rectilinear-curvilinear.

More in detail, the excavation of the two pipes 1, 2 is done so these extend substantially horizontally; in other words, the inclination of the longitudinal directions D1, D2 with respect to a horizontal plane is substantially equal to 0° or in any case contained in a rather reduced interval, e.g., between 0° and 25°.

It must not be forgotten in fact that the pipes 1, 2 are part of a transport infrastructure of the road or railway type and, therefore, the possibility of the underground transport tunnel having a very accentuated gradient or, absurdly, vertical gradient, must be totally ruled out.

Once the construction of the first pipe 1 and of the second pipe 2 has been completed, the procedure according to the invention provides the step of making at least a bypass tunnel 4 connecting the first pipe 1 and the second pipe 2.

With reference to the embodiment shown schematically in FIG. 1, the bypass tunnels 4 to be made are more than one but it is easy to appreciate that their final number substantially depends on the length of the underground transport tunnel.

The construction phase of each bypass tunnel 4 comprises the following steps:

introducing a launching chamber 5 along the first pipe 1 up to a first predefined position P1 chosen along the longitudinal direction D1 of the first pipe 1, the launching chamber 5 being able to launch at least a tunnel boring machine 6;

introducing an arrival chamber 7 along the second pipe 2 up to a second predefined position P2 chosen along the longitudinal direction D2 of the second pipe 2, the arrival chamber 7 being able to receive the tunnel boring machine 6;

excavating the bypass tunnel 4 making the tunnel boring machine 6 move forward from the launching chamber 5 to the arrival chamber 7 along a transversal direction T to the first pipe 1 and to the second pipe 2.

The launching chamber 5 comprises a first base platform 8 on which is fitted a thrust system.

The first base platform 8 has a first side 8*a* which, in use, is turned towards a first portion 1*a* of the first pipe 1 through which the tunnel boring machine 6 will pass to excavate the bypass tunnel 4.

The first base platform 8 also has a second side 8*b*, opposite the first side 8*a*.

The thrust system has two linear actuators 13, of the type of two hydraulic jacks fitted horizontally at a predefined height with respect to the first base platform 8, and a pusher block 14, fittable on the linear actuators 13 and movable with them.

The linear actuators 13 are associated with the first base platform 8 in correspondence to the second side 8*b*, wherein the launching chamber 5 also has a shaped reaction wall 9 substantially matching a second portion 1*b* of the first pipe 1.

The second portion 1*b* consists in a stretch of the first pipe 1 which is diametrically opposite the first portion 1*a* and is that which, in use, is adjacent to the second side 8*b* of the first base platform 8.

In practice, depending on the conformation of the first pipe 1 in correspondence to the first predefined portion P1, the reaction wall 9 has a corresponding outline.

In the embodiment shown in the illustrations, in which the first pipe 1 has a tube shape with a circular cross section, the reaction wall 9 consists of a circular cylinder stretch.

The arrival chamber 7 essentially consists of a second base platform 16 having a third side 16*a* which, in use, is turned towards a third portion 2*a* of the second pipe 2 through which the tunnel boring machine 6 will pass to excavate the bypass tunnel 4.

The second base platform 16 also has a fourth side 16*b*, opposite the third side 16*a* and designed to be positioned in the proximity of a fourth portion 2*b* of the second pipe 2, diametrically opposite the third portion 2*a*.

The tunnel boring machine 6 consists of an outer metal shield 21 shaped like a straight cylinder and having, at an axial extremity, a rotating head 22 bearing the actual excavation tools 23.

The tunnel boring machine 6 is sized so as to allow to be introduced and moved along the pipes 1, 2.

In the embodiment shown in the illustrations, for example, where the cross section of the pipes 1, 2 has an approximate diameter of 6.5 m, the tunnel boring machine 6 has an approximate diameter of 4 m and a length in axial direction of below 3 m, more precisely about 2.7 m.

Inside the outer metal shield 21 is a compartment 24 in which the excavated material is collected and which is designed to be transported outside the underground transport tunnel.

The material excavated by the tunnel boring machine 6 can be extracted as it is or be mixed with a carrier fluid, of the bentonite mud type.

It is however underlined that, preferably, the discharge of the excavated material is obtained by means of a system 25 of the "slurry" type, i.e., a system that permits pumping the carrier fluid outside the outer metal shield 21 directly onto the material to be excavated.

During the excavation, the carrier fluid is mixed with the excavation material outside the tunnel boring machine 6, fills the space between the outer metal shield 21 and the profile of the land and is kept at a pressure such as to ensure the stability of the front and prevent the penetration of ground water, if present, ensuring the excavatability and safety of the excavation.

The excavated material mixed to the carrier fluid is therefore discharged through a system of tubes, not shown in the illustrations.

Before starting the actual excavation phase, therefore, the procedure according to the invention involves an additional phase which consists in the impermeabilization of the launching chamber 5 to the first pipe 1.

In practice, in correspondence to the first side 8*a* of the first base platform 8 the construction is envisaged of a first impermeabilization structure 10, which prevents the carrier fluid pumped by the tunnel boring machine 6 from flooding the first pipe 1.

The first impermeabilization structure 10 consists, e.g., of a first shaped wall 11 substantially matching the first portion 1*a* of the first pipe 1.

The first wall 11 has a first seal 12, of circular shape, through which the tunnel boring machine 6 passes.

With the first wall 11, furthermore, a first pressurization system can be usefully associated, not shown in detail in the illustrations, which pressurizes the first impermeabilization structure 10 to ensure its seal during the crossing of the tunnel boring machine 6.

Similarly, the procedure envisages an identical additional phase which consists in the impermeabilization of the arrival chamber 7 to the second pipe 2, which is implemented by envisaging the construction, in correspondence to the third side 16*a* of the second base platform 16, of a second impermeabilization structure 17, which prevents the carrier fluid pumped by the tunnel boring machine 6 from flooding the second pipe 2.

The second impermeabilization structure 17 consists, e.g., of a second shaped wall 18 substantially matching the third portion 2*a* of the second pipe 2.

The second wall 18 has a second seal 19, of circular shape, through which the tunnel boring machine 6 passes.

With the second wall 18, furthermore, a second pressurization system can be usefully associated, not shown in detail in the illustrations, which pressurizes the second impermeabilization structure 17 to ensure its seal during the crossing of the tunnel boring machine 6.

The excavation phase of the bypass tunnel 4 occurs by pushing the tunnel boring machine 6 along the transversal direction T by means of the thrust system present in the launching chamber 5.

Figure 4:
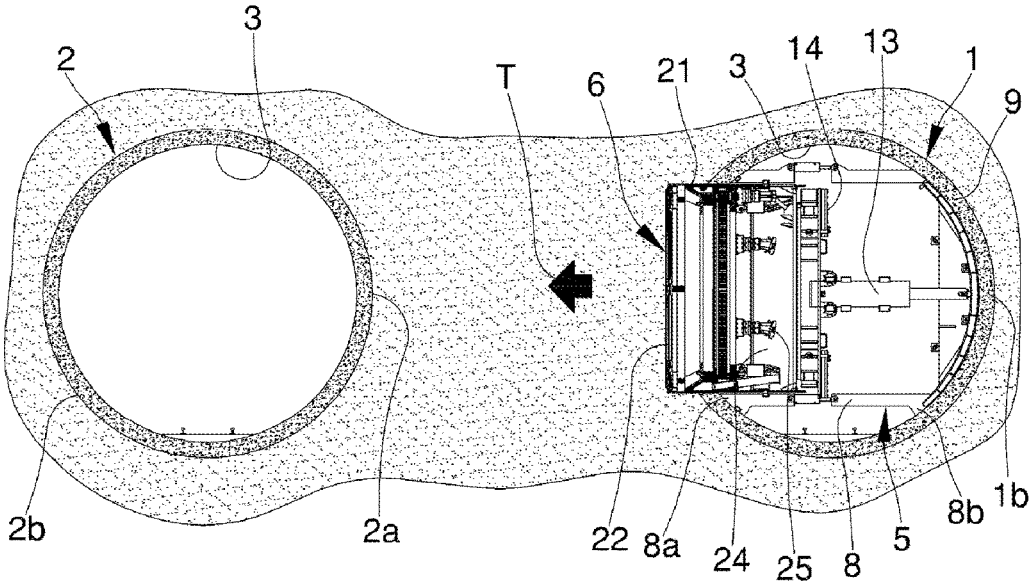

For this purpose, the tunnel boring machine 6 is fitted on the first base platform 8 with the rotating head 22 turned towards the first portion 1*a* (FIG. 3), and thus pushed by the linear actuators 13 so as to break through the first portion 1*a* itself (FIG. 4).

The excavation of the bypass tunnel 4 also comprises an additional phase which consists in conveying a plurality of precast segments 26 along the first pipe 1 up to the launching chamber 5 and placing the precast segments 26 one by one between the tunnel boring machine 6 and the thrust system.

The precast segments 26 have a cylindrical ring shape with a central axis A.

The precast segments 26 have a fairly reduced length and diameter slightly below that of the tunnel boring machine 6; in the embodiment shown in the illustrations, for example, the length of the precast segments 26 is equal to about 1.2-1.5 m while the diameter is 3.96 m.

When the precast segments 26 are interposed between the tunnel boring machine 6 and the thrust system they are arranged coaxially to one another to form a tube which extends along the transversal direction T.

Figure 5:
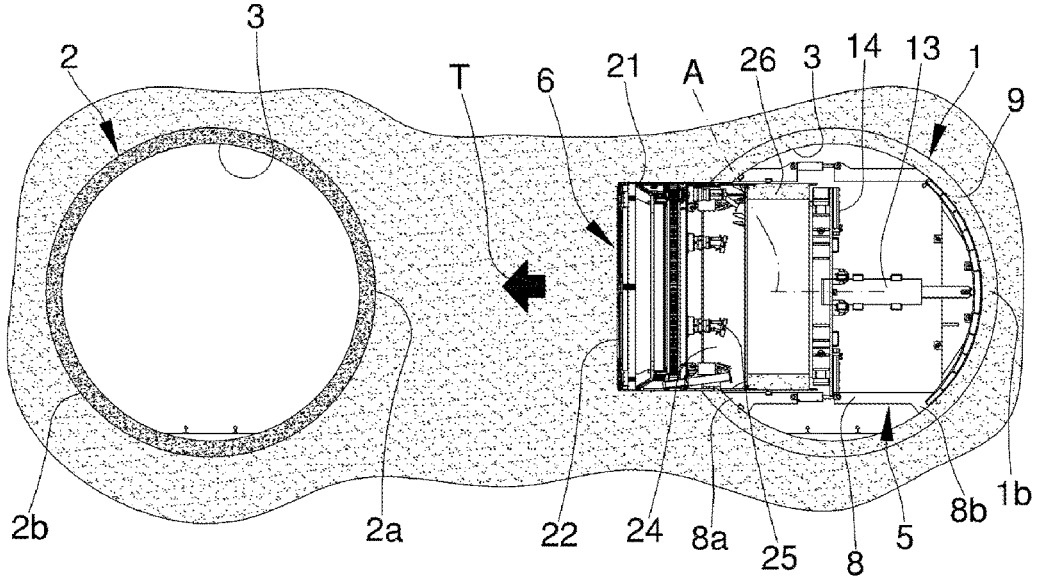
Figure 6:
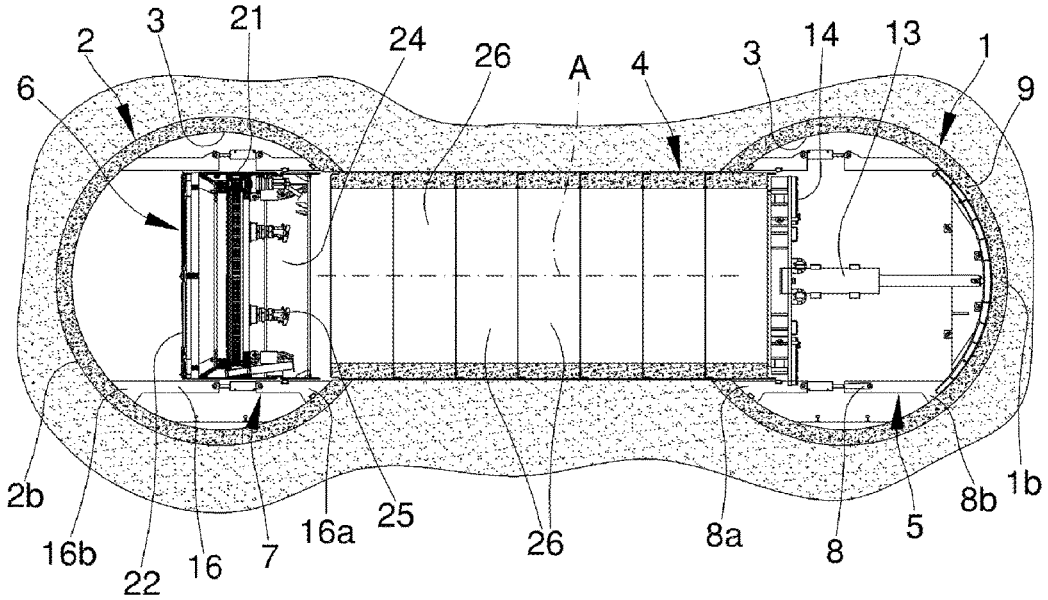

The excavation procedure thus continues with gradual forward movements substantially equal to the length of the precast segments 26 (as said equal e.g. to 1.2-1.5 m) operated by the thrust system which pushes both the precast segments 26 and the tunnel boring machine 6 (FIGS. 5 and 6).

Thanks to the system 25 of the "slurry" type, during the forward movement of the tunnel boring machine 6 along the transversal direction T, a pumping phase is envisaged of the carrier fluid on the material to excavate through the tunnel boring machine 6 and a discharge phase of the material to excavate mixed to the carrier fluid.

When the tunnel boring machine 6 reaches the second pipe 2, it breaks through the third portion 2*a* of the second pipe and rests on the second base platform 16.

The excavation of the bypass tunnel 4 is thus completed, the chambers 5, 7 and the tunnel boring machine 6 are removed by making them run along the pipes 1, 2 as far as the outside of the underground transport tunnel or until they are repositioned in approach to the next bypass tunnel 4.

Each bypass tunnel 4 excavated this way is designed to accommodate the future finishing and connecting works to the lining of the pipes 1, 2.

It has been found in practice how the described invention achieves the intended objects.

In particular, the fact is underlined that the procedure according to the invention permits:

- standardizing the geometries of the bypass tunnels (e.g., same section type and detail standardization);
- increasing the quality standards of the finished work;
- increasing the safety standards relating to the excavation operations with reference to workers safety during the construction phase and safety regarding impacts on the outside/surrounding environment;
- cutting the times required to make the bypass tunnels;
- cutting the costs to make the bypass tunnels.

The invention claimed is:

1. A method for the construction of underground transport infrastructures, comprising the steps of:

excavating at least an underground transport tunnel comprising a first pipe and a second pipe substantially parallel to one another; and making at least a bypass tunnel connecting said first pipe and said second pipe;

wherein said making at least a bypass tunnel comprises the sub-steps of:

introducing a launching chamber along said first pipe up to a first predefined position chosen along a longitudinal direction of said first pipe, said launching chamber configured to launch at least a tunnel boring machine;

introducing an arrival chamber along said second pipe up to a second predefined position chosen along a longitudinal direction of said second pipe, said arrival chamber configured to receive said tunnel boring machine as launched by said launching chamber; and excavating said bypass tunnel making said tunnel boring machine move forward from said launching chamber to said arrival chamber along a direction transverse to said longitudinal direction of each of said first pipe and said second pipe;

wherein said excavating the bypass tunnel comprises:

pushing said tunnel boring machine along said transversal direction by means of a thrust system present in said launching chamber;

conveying a plurality of precast segments along said first pipe up to said launching chamber;

interposing said precast segments one by one between said tunnel boring machine and said thrust system as said boring machine moves forward along said transversal direction; and pumping a carrier fluid on material to be excavated by said tunnel boring machine and discharging the excavated material mixed with the carrier fluid;

wherein, before starting said excavating the bypass tunnel by the tunnel boring machine, the method comprises impermeabilizing said launching chamber to said first pipe, including construction of a first impermeabilization structure having a first shaped wall substantially corresponding to a portion of the first pipe and configured to prevent the carrier fluid from flooding the first pipe, and impermeabilizing said arrival chamber to said second pipe, including construction of a second impermeabilization structure having a second shaped wall substantially corresponding to a portion of the second pipe and configured to prevent the carrier fluid from flooding the second pipe.

2. The method according to claim 1, wherein said precast segments have a cylindrical ring shape and a central axis, and wherein said interposing the precast segments further comprises consecutively arranging said precast segments coaxial to one another to form a tube which extends along said transverse direction.

3. The method according to claim 1, wherein said launching chamber comprises a shaped reaction wall substantially matching a portion of said first pipe in correspondence to said first predefined position.

4. The method according to claim 1, wherein the first shaped wall has a first seal and the second shaped wall has a second seal, each of the first and second seals configured to permit at least a portion of the tunnel boring machine to pass therethrough while excavating said bypass tunnel.

5. The method according to claim 1, wherein said first pipe and said second pipe extend substantially horizontally.

* * * * *